US007021562B2

(12) United States Patent
Mansour et al.

(10) Patent No.: US 7,021,562 B2
(45) Date of Patent: Apr. 4, 2006

(54) MACROLAMINATE DIRECT INJECTION NOZZLE

(75) Inventors: Adel B. Mansour, Mentor, OH (US); Michael A. Benjamin, Shaker Heights, OH (US)

(73) Assignee: Parker-Hannifin Corp., Cleveland, OH (US)

( * ) Notice: Subject to any disclaimer, the term of this patent is extended or adjusted under 35 U.S.C. 154(b) by 110 days.

(21) Appl. No.: 10/685,691

(22) Filed: Oct. 14, 2003

(65) Prior Publication Data

US 2004/0124282 A1 Jul. 1, 2004

Related U.S. Application Data

(60) Provisional application No. 60/427,089, filed on Nov. 15, 2002.

(51) Int. Cl.

| | |
|---|---|
| ***B05B 7/10*** | (2006.01) |
| ***B05B 1/30*** | (2006.01) |
| ***F02M 47/02*** | (2006.01) |
| ***F02M 59/00*** | (2006.01) |

(52) U.S. Cl. ..... 239/403; 239/399; 239/88; 239/533.1; 239/533.2; 239/533.14; 239/585.5

(58) Field of Classification Search ..... 239/403, 239/399, 88–92, 533.1, 533.2, 533.14, 429, 239/433, 585.1–585.5; 251/129.15, 129.21, 251/127

See application file for complete search history.

(56) References Cited

U.S. PATENT DOCUMENTS

| | | | | |
|---|---|---|---|---|
| 2,933,259 A | | 4/1960 | Raskin | |
| 3,062,275 A | | 11/1962 | Reed | |
| 3,913,845 A | | 10/1975 | Tsuji | |
| 4,568,026 A | * | 2/1986 | Baun | 239/551 |
| 4,739,933 A | * | 4/1988 | Hanano | 239/304 |
| 5,423,178 A | | 6/1995 | Mains | |
| 5,435,884 A | | 7/1995 | Simmons et al. | |
| 5,547,129 A | | 8/1996 | Fortunato et al. | |
| 5,713,205 A | | 2/1998 | Sciocchetti et al. | |
| 6,016,969 A | | 1/2000 | Tilton et al. | |
| 6,132,204 A | | 10/2000 | Snyder et al. | |
| 6,540,304 B1 | * | 4/2003 | Southern | 299/12 |

OTHER PUBLICATIONS

U.S. Appl. No. 60/427,089, filed Nov. 15, 2002, Adel Mansour Michael Benjamin, Macrolaminate Direct Injection Nozzle.

* cited by examiner

*Primary Examiner*—Davis Hwu
(74) *Attorney, Agent, or Firm*—Christopher H. Hunter

(57) ABSTRACT

A fuel injector for a gas turbine engine includes a bulkhead having adjacent angled wall segments, each of which includes an injector opening. Fuel injectors are supported by the bulkhead on adjacent wall segments. Each fuel injector includes an inlet fitting including ports for receiving fuel, a feed stem extending through the opening, and a manifold supported at the downstream end of the feed stem and including a plurality of manifold segments. Each manifold segment includes a plurality of nozzles arranged in a linear, planar array; with each nozzle including a fuel distribution assembly and an air swirler assembly. The manifold segments are supported at angles to one another, such that that the sprays from one array of nozzles in one segment are provided in a different direction than the sprays from another array of nozzles in an adjacent manifold segment.

40 Claims, 8 Drawing Sheets

MACROLAMINATE DIRECT INJECTION NOZZLE

CROSS-REFERENCE TO RELATED CASES

The present application claims the benefit of the filing date of U.S. Provisional Application Ser. No. 60/427,089, filed Nov. 15, 2002, the disclosure of which is expressly incorporated herein by reference

FIELD OF THE INVENTION

The present invention relates generally to fuel injectors, and more particularly, to fuel injectors useful for gas turbine combustion engines.

BACKGROUND OF THE INVENTION

Fuel injectors useful for applications such as gas turbine combustion engines, direct pressurized fuel from a manifold to one or more combustion chambers. Fuel injectors also function to prepare the fuel for mixing with air prior to combustion. Each injector typically has an inlet fitting connected either directly or via tubing to the manifold, a tubular extension or stem connected at one end to the fitting, and one or more spray nozzles connected to the other end of the stem for directing the fuel into the combustion chambers. A fuel passage (e.g., a tube or cylindrical passage) extends through the stem to supply the fuel from the inlet fitting to the nozzle. Appropriate valves and/or flow dividers can be provided to direct and control the flow of fuel through the nozzle. The fuel injectors are often placed in an evenly-spaced annular arrangement to dispense (spray) fuel in a uniform manner into the combustion chamber. Additional concentric and/or series combustion chambers each require their own arrangements of nozzles that can be supported separately or on common stems. The fuel provided by the injectors is mixed with air and ignited, so that the expanding gases of combustion can, for example, move rapidly across and rotate turbine blades in a gas turbine engine to power an aircraft, or in other appropriate manners in other combustion applications.

One technique for creating an efficient spray of fuel is to provide the air in a swirling motion surrounding the fuel spray. The swirling air causes the fuel to have a swirling component of motion, which causes quick and uniform mixing of the fuel with the air, and thereby better atomization. A well-atomized spray of fuel results in lower flame temperatures in the combustor, which more efficiently and completely burns the fuel and results in lower emissions of pollutants such as Nitrous Oxide (NOx). It is therefore desirable to maximize the swirling flow of air around the fuel spray to maximize the efficiency of the engine.

Because of limited fuel pressure availability and a wide range of required fuel flow, many fuel injectors include pilot and secondary nozzles, with only the pilot nozzles used during start-up, and both the pilot and secondary nozzles used during higher power operation. There is no flow or only low flow through the secondary nozzles during start-up, idle and lower power operation. Such injectors can be more efficient and cleaner-burning than single nozzle fuel injectors, as the fuel flow can be more accurately controlled and the fuel spray more accurately directed for the particular combustor requirement. The pilot and secondary nozzles can be contained within the same nozzle stem assembly or can be supported in separate nozzle assemblies.

One particularly useful spray nozzle is shown and described in Simmons, et al., U.S. Pat. No. 5,435,884, which is owned by the assignee of the present invention. In the Simmons patent, a spray nozzle is formed from multiple plates using chemical etching. A bowl shaped swirl chamber, a spray orifice, non-radial feed slot and an annular feed annulus are each formed in one or more of the plates. Such a spray nozzle has been found to be efficient in its performance, provide low emissions, and be relatively easy to manufacture compared with many mechanically-formed nozzles, particularly for nozzles with a low Flow Number (the relation of the rate of liquid flow output to the applied inlet pressure) and small dimensions.

One particularly useful application of the Simmons spray nozzle has been developed by the assignee of the present invention. The application includes supporting an air swirler assembly downstream of the spray nozzle to impart a swirling component of motion to the fuel. The air swirler assembly is also formed from multiple plates, and includes a cylindrical air swirler passage in at least one of the plates, located in co-axial relation to the spray orifice of the nozzle assembly such that fuel directed through the spray orifice passes through the air swirler passage and swirling air can be imparted to the fuel. A pair of air feed slots are in fluid communication with each air swirler passage and extend in non-radial relation thereto for supplying air to be swirled in the air swirler passage. This application is described in more detail in U.S. patent application Ser. No. 09/794,490, filed Feb. 27, 2001, for "Integrated Fluid Injection and Mixing System".

One issue that occurs with injectors having pilot and secondary nozzles is that the nozzles are typically supported close to each other, and the air flow for the secondary nozzles can interfere with, and sometimes even quench, the flame from the pilot nozzles, particularly when the fuel flow from the secondary nozzles is low or off (start-up, low power or idle conditions). This is because the air flow for the secondary nozzles is typically not controlled, and is always present regardless of whether fuel is being supplied to the secondary nozzles. This is particularly an issue with applications which require multiple nozzles to be supported in a small space, where interaction between the sprays can cause a significant reduction in the efficiency of the engine. Reducing the air flow is one solution, but in doing so it becomes more difficult to achieve uniform and rapid mixing of the air and fuel and hence the atomization suffers. As discussed above, a poorly-atomized fuel spray causes higher flame temperatures during combustion, resulting in higher emissions of Nitrous Oxide.

With current trends toward developing even more efficient and cleaner-burning combustors, which require increased air flow for even more efficient operation, it is a continuing challenge to develop improved fuel injector assemblies to properly deliver fuel to a combustion chamber for operation of the gas turbine engine, which fits into a small envelope, and can be manufactured and assembled in an economical manner.

SUMMARY OF THE PRESENT INVENTION

The present invention provides a novel and unique fuel injector for directing fuel from a manifold and dispensing the fuel within the combustion chamber of a gas turbine combustion engine. The fuel injector has increased air flow to provide quick and uniform mixing of the fuel and air to achieve fine atomization. Combustion occurs at lower flame temperatures, thereby reducing NOx emissions from the engine. The fuel injector of the present invention also fits within a small envelope and is economical to manufacture and assemble. The fuel injector is particularly useful for gas turbine combustion engines on aircraft, but it is believed it can also be useful in other combustion applications, such as in ground vehicles and stationary applications, or for dispensing liquids other than fuel.

According to a preferred embodiment of the present invention, the engine assembly includes a plurality of fuel injectors supported by a bulkhead, where the bulkhead includes adjacent angled wall segments, with each wall segment including an injector opening. The fuel injectors are supported by the bulkhead at an angle to one another on adjacent wall segments. Each fuel injector includes an inlet fitting having one, and preferably at least two ports for receiving fuel, a stem assembly connected to the fitting and extending through the opening, and a manifold supported at the downstream end of the stem assembly. Preferably the manifold includes three elongated manifold segments.

Each manifold segment includes a plurality of nozzles arranged in a linear, planar array, spaced evenly along the length of the segment. Each nozzle includes a multi-layered fuel distribution assembly including i) a swirl chamber having a shape such that fuel to be sprayed can move therein in a vortex motion toward the center of the swirl chamber, ii) a feed annulus surrounding the swirl chamber, iii) at least one non-radial feed slot interconnecting the feed annulus and the swirl chamber for directing fuel to the swirl chamber, and iv) a spray orifice at the center of the swirl chamber such that fuel to be sprayed can move from the swirl chamber to the spray orifice and then exit the spray orifice in a thin film which soon atomizes into a fine droplet mist.

Each nozzle further includes a multilayered air swirler assembly. The air swirler assembly is supported against the fuel distribution assembly and includes cylindrical air swirler passages. The cylindrical air swirler passages are located in co-axial relation to the spray orifices of the nozzle assemblies such that fuel directed through each spray orifice passes through an air swirler passage and swirling air can be imparted to the fuel to cause the fuel to have a swirling component of motion. A pair of air feed slots are in fluid communication with each air swirler passage and extend in non-radial relation thereto for supplying air to be swirled in the air swirler passage.

A pair of air supply passages, located to receive air from the gas turbine engine, feed respective air feed slots in each air swirler passage. The air supply passages extend the length of the manifold plate, on either side of the linear array of nozzles.

The layers of the fuel distribution assembly and of the air swirler assembly are preferably formed by etching individual plates, and then layering and bonding the plates together in surface-to-surface adjacent relation with each other. The etching provides repeatability and enables generation of a plurality of substantially uniform fuel sprays from the nozzles.

According to the present invention, each manifold segment is supported at an angle to an adjacent manifold segment, such that that the sprays of fuel from one linear, planar array of nozzles in one manifold segment is provided in one direction, while the sprays of fuel from another linear, planar array of nozzles on an adjacent manifold segment is provided in another direction, at an angle to the sprays from the first manifold. The manifold segments can be separately fluidly connected to the stem, and receive fuel in separate circuits, such that one or more of the manifold segments can provide fuel from one circuit, while one or more manifold segments can provide fuel from another circuit. Preferably the manifold segments are arranged such that a middle or central manifold segment provides sprays of fuel in a pilot fuel circuit; while the manifold segments adjacent both sides of the pilot manifold segment are angled at 45 degrees to the pilot manifold segment, and provide fuel in secondary fuel circuits.

Since the air swirler assemblies for the nozzles of the secondary manifold segments are supported at an angle to the air swirler assemblies for the nozzles of the pilot manifold segment, the interaction of the air flows is reduced, and quenching is prevented. A greater amount of air flow can be directed through the swirler assemblies to increase the fine atomization and quick and uniform mixing of the fuel, without the air flow from the secondary nozzles interfering with the flame in the pilot nozzle.

The present invention thereby provides a novel and unique fuel injector for directing fuel from a manifold and dispensing the fuel within the combustion chamber of a gas turbine combustion engine. The fuel injector provides increased air flow to achieve fine atomization and quick and uniform mixing of the fuel and air for combustion at low flame temperatures, thereby reducing NOx emissions from the engine. The fuel injector of the present invention also fits within a small envelope and is economical to manufacture and assemble. The fuel injector is particularly useful for gas turbine combustion engines on aircraft, but can also be useful in other combustion applications, such as in ground vehicles and stationary applications, or for dispensing liquids other than fuel.

Other features and advantages of the present invention will become further apparent upon reviewing the following specification and attached drawings.

DETAILED DESCRIPTION OF THE PREFERRED EMBODIMENT

Figure 1:
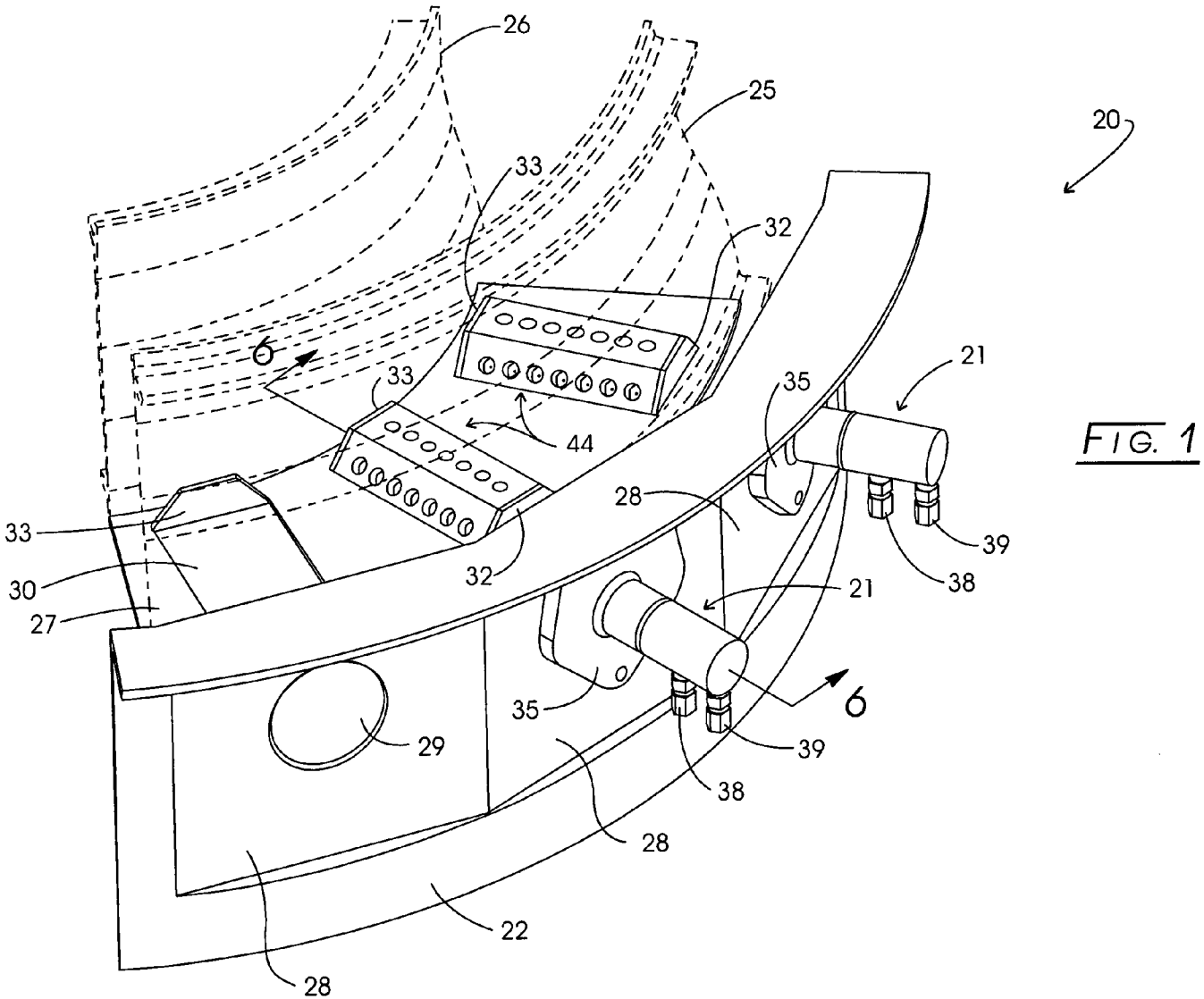
FIG. 1 is an elevated perspective view of a portion of a combustion chamber for a gas turbine engine, from the outside of the combustor and with portions shown in phantom for clarity, showing a plurality of fuel injectors constructed according to the principles of the present invention.
Figure 2:
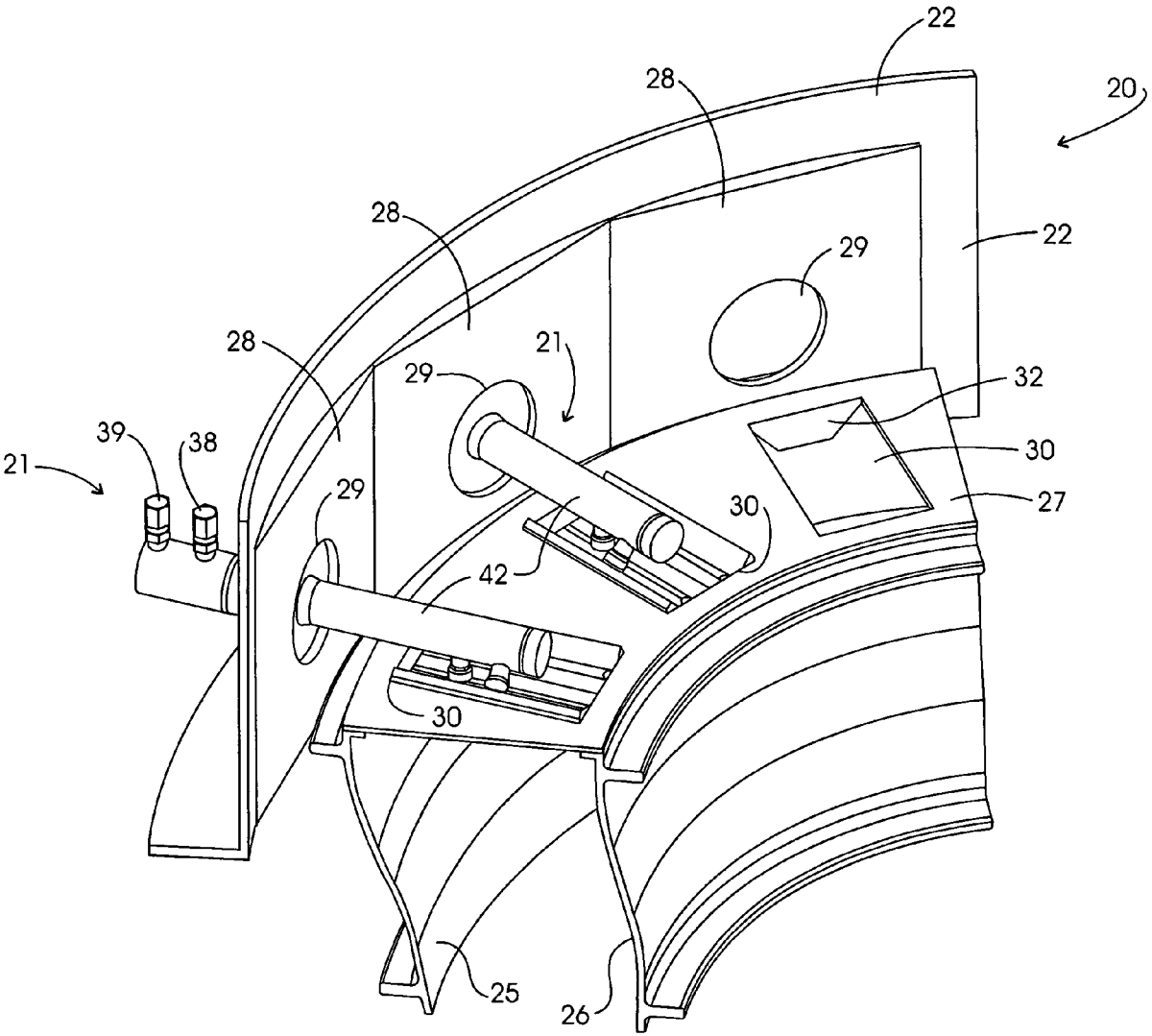
FIG. 2 is an elevated perspective view similar to FIG. 1, from the inside of the combustor.

Referring to the drawings and initially to FIGS. 1 and 2, a portion of a combustor for a gas turbine engine is indicated generally at 20. Air at elevated temperatures (up to 1300° F. in the combustion chamber of an aircraft), is directed into the combustor to facilitate the combustion of fuel. A plurality of fuel injectors, for example as indicated generally at 21, are shown supported within the combustor for dispensing fuel.

Combustor 20 is illustrated as including an outer, axially-extending annular wall or bulkhead at 22, and a pair of spaced-apart, internal, axially-extending annular liners 25, 26 interconnected by a radially-extending annular dome 27, at the upstream end of the liners 25, 26. The liners 25, 26 are configured to direct the fuel dispensed from injectors 21 into the combustor in an appropriate manner. The annular liners 25, 26 and dome 27 are formed of material appropriate for the particular application, and are attached to each other preferably in a conventional manner (e.g., by welding).

The bulkhead 22 is typically attached within the engine casing by brackets, and is illustrated as including a series of abutting flat wall segments, as at 28, extending in the axial direction and angled with respect to one another. Each wall segment includes a circular injector opening, as at 29, in about the middle of the wall segment. While the present invention is particularly applicable to such a bulkhead with adjacent flat wall segments, it should be appreciated that the bulkhead could have other configurations, such as continuously smooth and annular.

In any case, a plurality of rectangular, radially-extending openings as at 30, are formed in the dome 27, in an evenly spaced-apart arrangement around the dome, corresponding to the location of injector openings 29. Each opening 30 is bounded at its radial ends by short, axially-extending end walls 32, 33, which comprise a portion of the material removed to make openings 30.

While a specific example of a preferred combustor for a gas turbine combustion engine of an aircraft is shown and described, it should be apparent that other combustion chamber configurations are possible. For example, the combustor is shown in FIGS. 1 and 2 as supporting only a single annular row of injectors; however it should be noted that this is only for exemplary purposes, and the present invention is useful with combustors supporting multiple rows of injectors, in a concentric and/or series configuration. It should also be noted that while a number of such injectors are shown in an evenly-spaced annular arrangement, then number and location of such injectors can vary, depending upon the particular application. One of the advantages of the present invention it is that is useful with a variety of different combustor configurations. Moreover, while the fuel injector of the present invention is shown as being used in a combustion chamber, is believed that the injector could likewise be used in other combustion (and non-combustion) applications, where a fine spray of fluid is needed.

Figure 3:
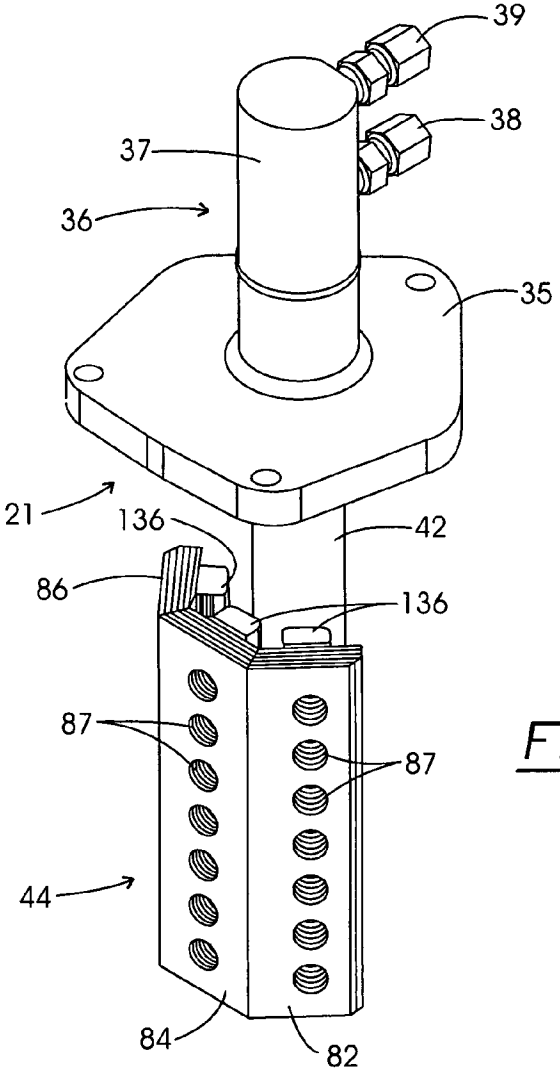
FIG. 3 is an elevated perspective view of one of the fuel injectors of FIG. 1.
Figure 4:
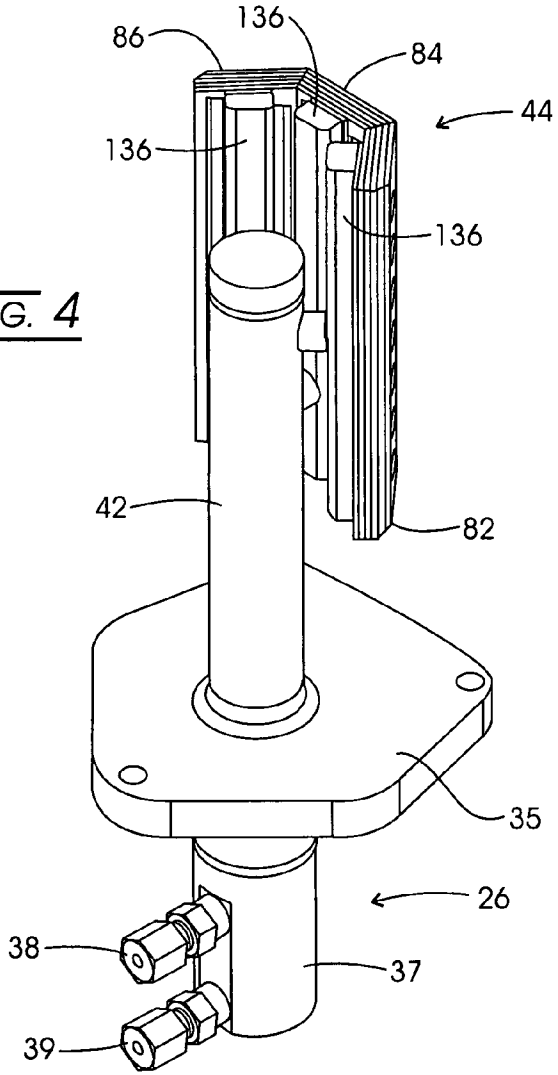
FIG. 4 is an elevated perspective view of the fuel injector of FIG. 3, from another view.
Figure 5:
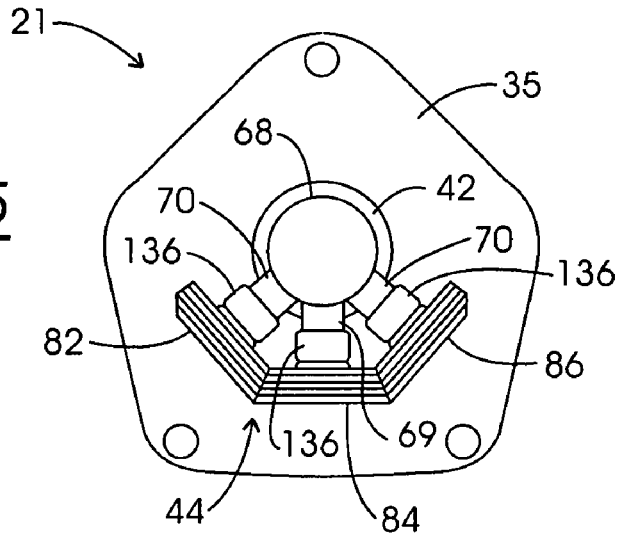
FIG. 5 is an inner end view of the fuel injector.

In any case, the injectors 21 are illustrated as being mounted to separate wall segments 28. Referring now to FIGS. 3–5, the fuel injectors 21 are preferably identical, and each includes a flat, radially-extending injector mount or flange 35 adapted to be fixed and sealed to the outer surface of the respective wall segment of the bulkhead (see FIG. 1) with appropriate fasteners. The flat surface of the wall segment and of the nozzle flange facilitates the flush fit of the injectors to the combustor wall. The injector further includes an inlet fitting, indicated generally at 36, including an outer stem 37 integral or fixed to mount 35 (such as by brazing or welding), which projects axially outwardly from the flange 35. One, and preferably two ports 38, 39 are provided in fitting 36 which are adapted to be connected in an appropriate manner to fuel lines in the engine. An inner stem 42 also integral or fixed to mount 35 extends axially inward from mount 35 through the injector opening 29 (see FIG. 2), and supports a manifold, indicated generally at 44, mounted within dome opening 30 of the combustor. The inner stem 42 is shown as being straight, but it should be noted that some applications might require a bent or curved stem.

Figure 6:
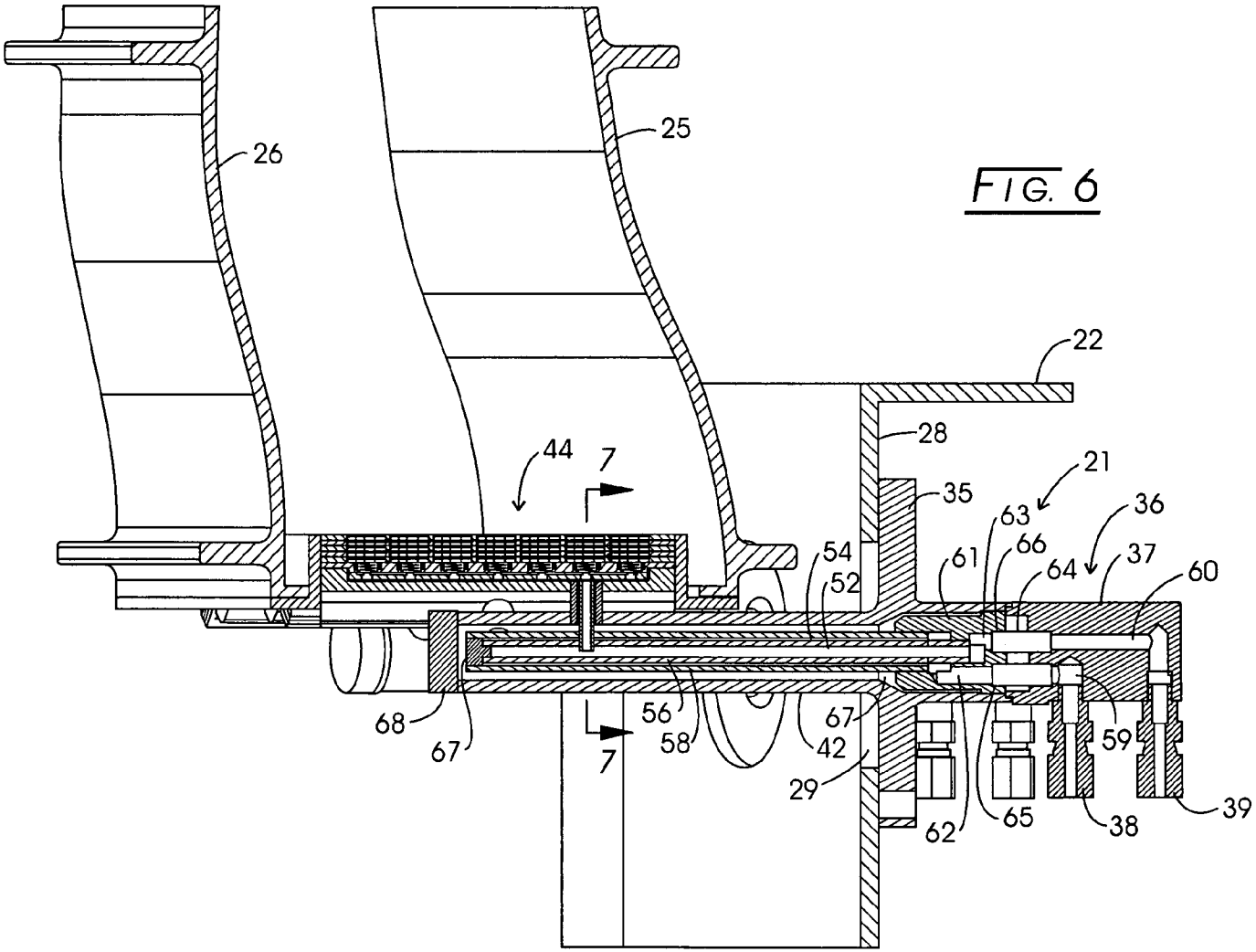
FIG. 6 is a cross-sectional side view of the fuel injector, taken substantially along the plane described by the lines 6—6 in FIG. 1.

Referring now to FIG. 6, each fuel injector 21 preferably has two fuel circuits 52, 54, one of which (52) is a pilot circuit which is typically operational during the entire engine operation (idle, low flow, etc. to maximum power), and the other of which (54) is a secondary circuit which is typically operational as the engine reaches medium to maximum power conditions. To this end, inner stem 42 includes a pair of co-axial conduits 56, 58; and outer stem 37 includes a pair of spaced-apart passages 59, 60, which provide fluid separate paths between ports 38, 39 and manifold 44. An adapter body 61 with internal passages 62, 63 is provided at the junction between conduits 56, 58 and passages 59, 60, to interconnect passage 59 with circuit 54; and passage 60 with circuit 52. Short conduits 64, 65 are provided to fluidly connect the respective internal passages 62, 63 in adapter 63 with passages 59, 60, in outer stem 37. Appropriate O-rings as at 66, provide a fluid-tight seal between the adapter and conduits 64, 65. An air gap 67 is shown surrounding outer conduit 58, adapter 63, and at least a part of conduits 64, 65, for thermal insulation purposes. The distal, downstream ends of conduits 56, 58 are closed off by cap 67, while the distal, downstream end of stem 42 is closed off by cap 68.

Figure 7:
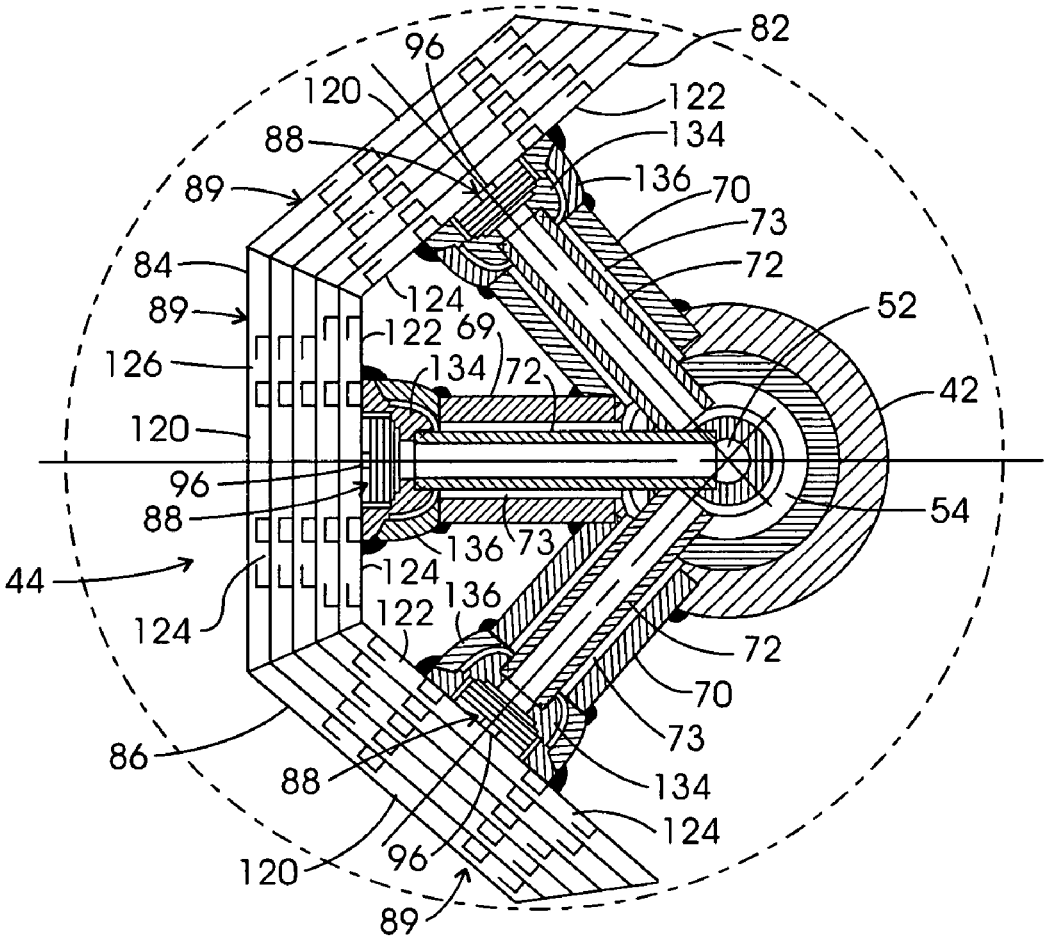
FIG. 7 is an enlarged, cross-sectional end view of a portion of the fuel injector taken substantially along the plane described by the lines 7—7 of FIG. 6.

As shown in FIG. 7, the fuel circuits 52, 54 in stem 42 are fluidly connected via short extensions 69, 70, respectively, to the manifold 44. Two extensions 70 are shown, for providing two separate fluid paths from the secondary circuit 54 to the manifold; while only a single extension 69 is shown for providing a single fluid path from the pilot circuit 52 to the manifold. Each extension includes a short internal tube as at 72 projecting through an opening in one or both conduits 56, 58 in the stem and interconnecting the respective circuit in stem 42 with the manifold. The internal tube 72 for extension 69, for example, extends through an opening in outer conduit 58 and inner conduit 56 to fluidly connect the manifold with pilot fuel circuit 52; while internal tube 72 in extensions 70 extend through only outer conduit 58 to fluidly connect the manifold with the secondary fuel circuit 54. An insulating air gap 73 surrounds each internal tube for thermal management purposes. Extensions 69, 70 are shown as projecting radially outward from stem 42 close to the distal, downstream end of the stem, and are fixed to the stem and to the manifold in a conventional manner, such as by brazing. Extensions 70 are located slightly axially downstream along stem 42 from extension 69, although the extensions could be located at any axial position along stem 42 as is appropriate.

Figure 8:
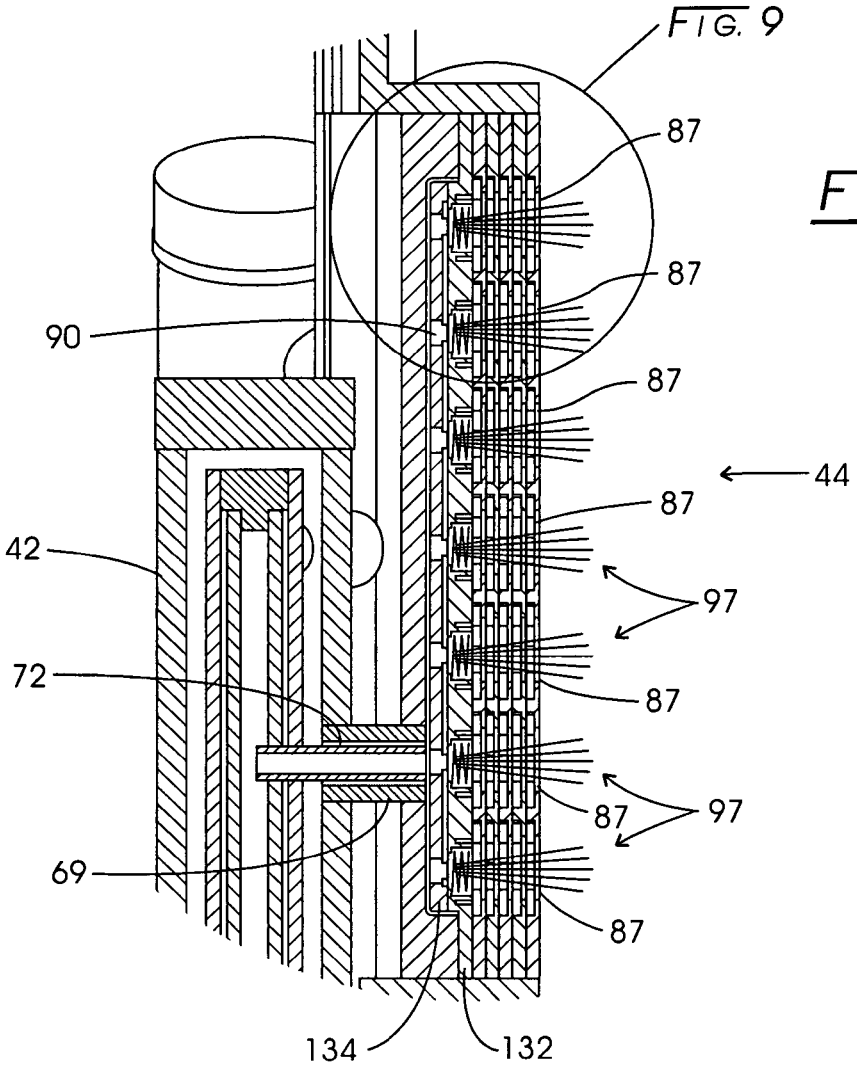
FIG. 8 is an enlarged, cross-sectional side view of a portion of the fuel injector of FIG. 7.
Figure 10:
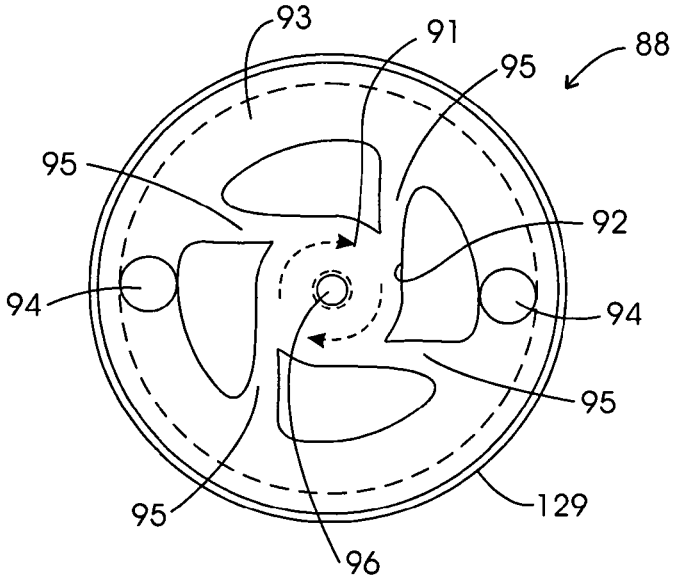
FIG. 10 is a front view of one of the plates of the fuel distribution assembly for one of the manifold segments of the fuel injector.
Figure 9:
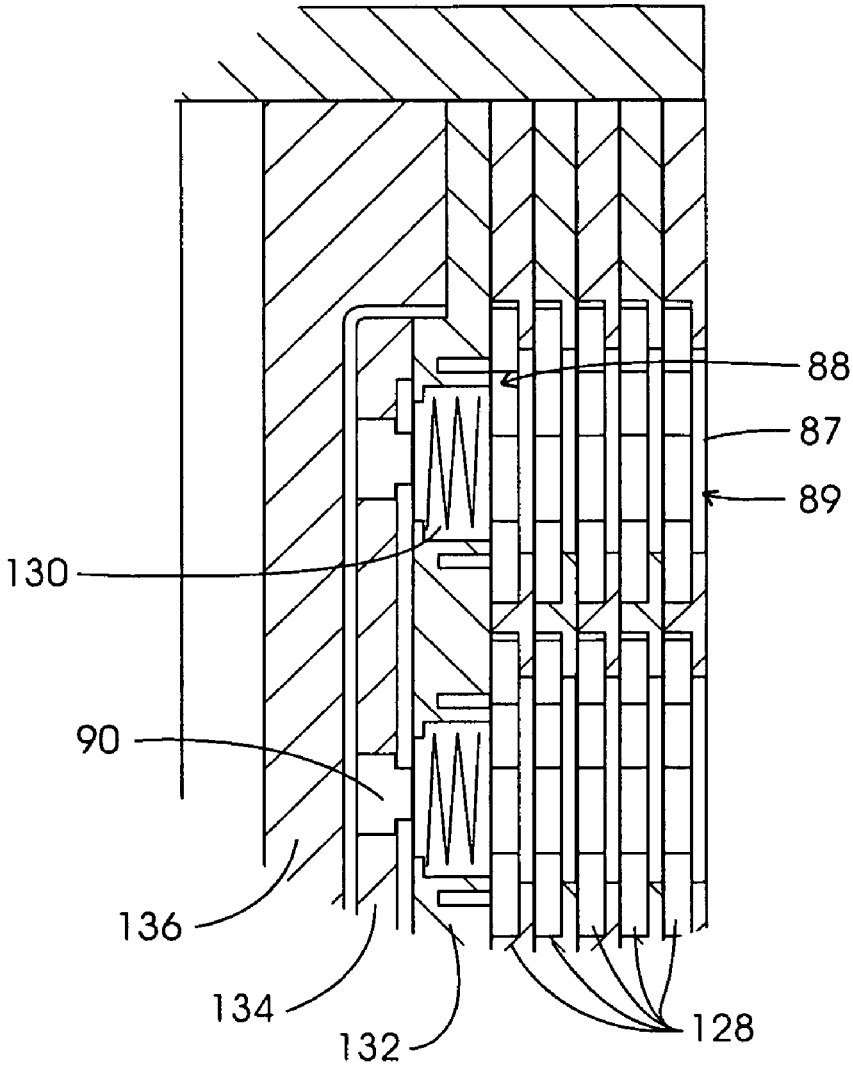
FIG. 9 is a further enlarged, cross-sectional side view of a portion of the manifold segment for the injector of FIG. 8.

As shown in FIG. 3, the manifold 44 includes three elongated manifold segments 82, 84 and 86, each of which has a somewhat rectangular shape with an outer planar surface and adjoining and contiguous side edges. Each manifold segment includes a plurality of nozzles, as at 87, arranged in a linear, planar array, spaced evenly along the length of the respective segment, and along about the median line of the segment. Referring now to FIGS. 7–9, each nozzle is comprised of a fuel distribution assembly, indicated generally at 88, and an air swirler assembly, indicated generally at 89. A passage 90, internal to the manifold segment, fluidly interconnects internal tube 72 in the respective extension 69, 70 with each of the nozzles 87. As shown also in FIG. 10, the fuel distribution assembly 88 includes a swirl chamber, indicated generally at 91, defined by a bowl-shaped wall 92, such that liquid to be sprayed can move therein in a vortex motion toward the center of the swirl chamber. A feed annulus 93 surrounds swirl chamber 91, and receives fuel from axial passages 94, which are fluidly interconnected with the internal passage 90 in the manifold segment. At least one non-radial, trough-shaped feed slot 95 fluidly interconnects annulus 93 and swirl chamber 91 for directing liquid to the swirl chamber. A circular spray orifice 96 is provided at the center of the swirl chamber such that liquid to be sprayed can move from the swirl chamber to the spray orifice and then exit the spray orifice in a thin film, as at 97 (FIG. 8), which soon atomizes into a fine droplet mist.

Figure 11:
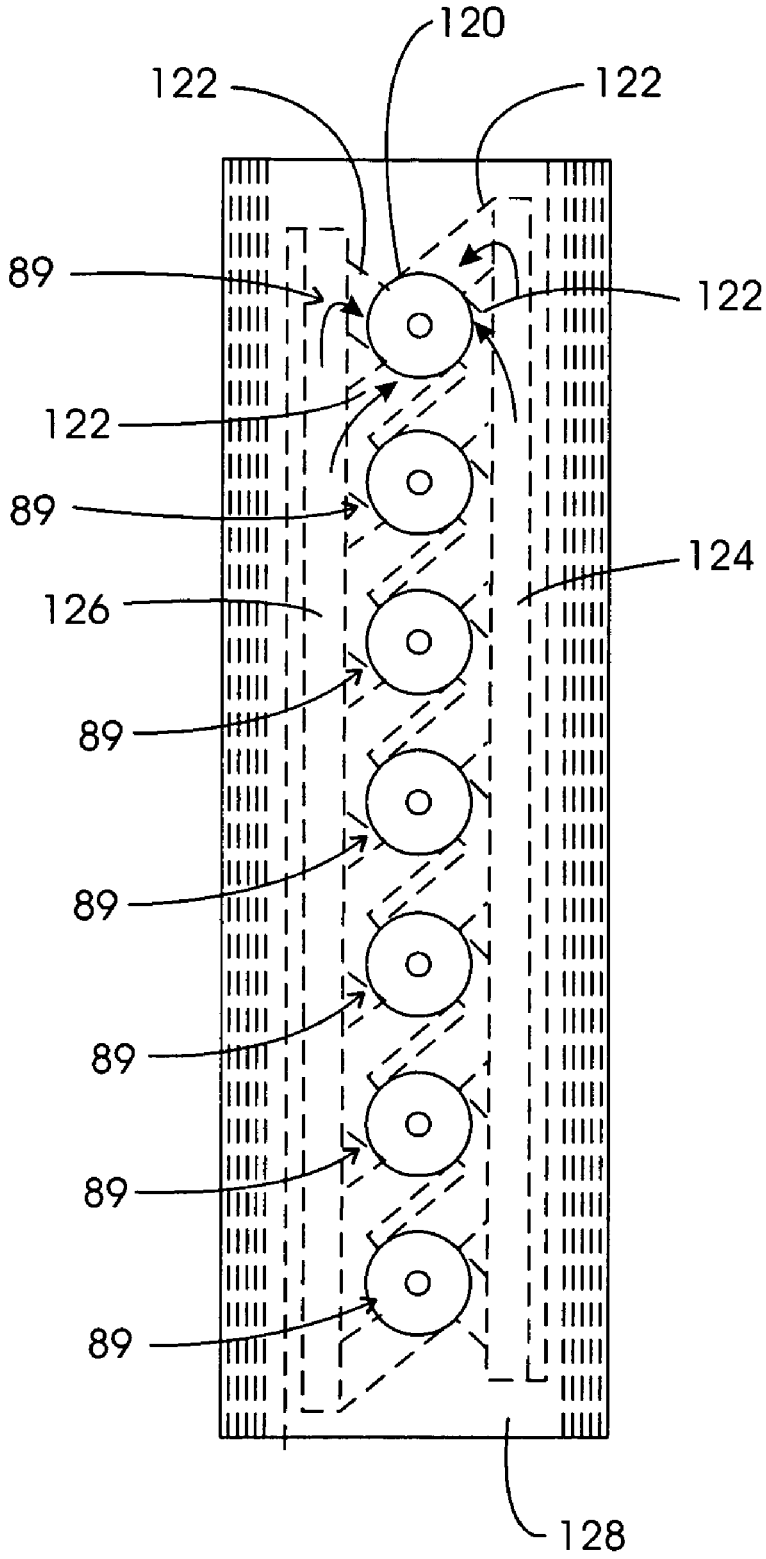
FIG. 11 is a front view of an air swirler assembly for one of the manifold segments with portions shown in phantom.

The air swirler assembly 89 is supported against the fuel distribution assembly, and as shown in FIGS. 7, 8 and 11, includes cylindrical air swirler passages 120 located in co-axial relation to the spray orifices 96 of the fuel distribution assemblies such that fuel directed through each spray orifice passes through a respective air swirler passage, and swirling air can be imparted to the fuel to cause the fuel to have a swirling component of motion. Air feed slots 122 are in fluid communication with each air swirler passage 120 and extend in non-radial relation thereto for supplying air to be swirled in the air swirler passage.

As such, each nozzle 87 includes a fuel distribution portion which creates a fuel spray, and an air swirler portion which imparts a swirling component of motion to each fuel spray for quick and uniform mixing of the fuel and fine atomization. Further discussion of a similar fuel distribution assembly and air swirler assembly can be found in U.S. patent application Ser. No. 09/794,470, filed Feb. 27, 2001, for "Integrated Fluid Injection and Mixing System", which is incorporated herein by reference.

A pair of air supply passages 124, 126, located to receive air from the gas turbine engine, feed respective air feed slots in each air swirler passage. The air supply passages extend the length of the manifold plate, preferably on either side of the linear array of nozzles.

The fuel distribution assembly 88 and the air swirler assembly 89 are each preferably formed from one or more layers. The layers of the fuel distribution assembly and of the air swirler assembly are preferably formed by etching through thin plates of etchable material, e.g., metal sheets, and then layering the plates in surface-to-surface adjacent relation with each other and bonding them together, such as by high temperature brazing. The etching provides repeatability, efficient fuel flow and enables generation of a plurality of substantially uniform fuel sprays from the nozzles.

The air swirler assemblies 89 are preferably formed from multiple elongated plates 128, stacked in adjacent relation to one another, with each plate including portions of multiple air swirler passages, namely a circular opening and (in some plate(s)) one or more feed slots and/or air supply passages. When the plates are stacked together, the circular openings align to form the cylindrical air swirler passages 120, with the air feed slots 122 located to direct air radially inward at one or more layer of the air swirler assembly.

The fuel distribution assemblies 88 are likewise formed from one or more plates, however, the fuel distribution assemblies are preferably each formed from separate plates, for example, one or more small circular plates as at 129 (FIG. 10), where one or more of the plates includes one or more of the constituents of the fuel distribution assembly, namely the swirl chamber, spray orifice, feed annulus and feed slots. The plates are then stacked together, and inserted within appropriately-sized circular openings as at 130 in an elongated plate 132 of the manifold segment. The plates 128 of the air swirler assembly are then located against the plate 132 of the fuel distribution assembly and fixed thereto, such as by high-temperature brazing.

The internal passage 90 in the manifold segment is shown as being formed in an elongated rear distribution plate 134 of the manifold segment. Distribution plate 134 preferably extends the length of the manifold segment. As shown also in FIGS. 3, 4 and 7, an elongated, cup-shaped cover plate 136 receives and encloses the distribution plate to provide thermal shielding therefore. The distribution plate 134 and cover plate 136 also serve as a support for the multiple plates of the air swirler assembly and the fuel distribution assembly, and are fixed to the manifold in an appropriate manner, such as by high-temperature brazing.

The number of plates in the fuel distribution assembly and each air swirler assembly, and the dimensions of the orifices, swirl chamber and passages, can vary depending upon the particular application. Certain plates, such as distribution plate 136 and rear plate 132, could be combined as one; or some plates could be split into further plates, depending upon the particular requirements of the application, and the difficulty in manufacturing the geometries on each plate. Further discussion of chemically and electromechanically etching passages such as a feed annulus, inlet slots, swirl chambers and swirler structure in thin metal plates can be found in U.S. Pat. Nos. 5,435,884 and 5,740,967, which are incorporated herein by reference. Other conventional etching techniques, which should be known to those skilled in the art, are also possible. Mechanically forming (e.g., drilling) the plates, while less preferred, is also an option.

While each nozzle preferably comprises a pressure swirl atomizer for providing a hollow conical air-atomized fuel spray, it should be appreciated that other nozzle designs could alternatively (or in addition) be used with the present invention to provide other spray geometries, such as plain jet, solid cone, flat spray, etc. Also, while identical round spray orifices 96 are shown in fuel swirler plate, it should be appreciated that the dimensions and geometries of the orifices may vary across the plate, to tailor the fuel spray volume to the particular application. This can be easily accomplished by the aforementioned etching process.

Still further, while it is preferred that a plurality of manifold segments be supported in adjacent relation to one another, some applications may require only a single manifold segment, and/or a single fuel circuit. The dimensions of each manifold segment could also vary. While an elongated, rectangular-shaped manifold segment is preferred, such as to support a linear array of nozzles; the manifold segment could take other shapes, such as square, round, etc., depending upon the particular application.

Further, while seven nozzles are illustrated for each manifold segment, it should be understood that the number of nozzles could vary depending on the particular application, i.e., the desired fuel flow. Only a single nozzle might be appropriate in some applications, but it is noted that the present invention is particularly useful for injectors which provide a number of distribution points to maximize the amount of fuel that can be supplied into the combustor. Likewise, it should be understood that only a single linear array of nozzles is shown on each segment with the nozzles evenly spaced apart; however, the nozzles could be alternatively arranged in more than one row, or could be arranged in other than a linear, evenly spaced-apart array, for example i) in a staggered arrangement, where some of the nozzles might be close to one another, while other of the nozzles might be farther away from one another; or ii) in concentric circles located on angled frustoconical portions, with the pilot nozzles being arranged in an annular array on one angled portion, and the secondary nozzles being arranged in other annular arrays in other angled portions.

Each manifold segment 82, 84, 86 is supported at an angle to an adjacent manifold segment, such that that the sprays of fuel from one linear, planar array of nozzles on one manifold segment is provided in one direction, while the sprays of fuel from another linear, planar array of nozzles on an adjacent manifold segment is provided in another direction, at an angle to the first sprays. Preferably the manifold segments are supported at an angle of forty-five degrees (45°) with respect to each other, to reduce the interaction of the sprays from adjacent manifold segments. Of course, it should be appreciated that the angle at which the manifold segments are supported relative to each other can vary, depending upon the fuel and air flows, and the number of nozzles supported on the manifold segments.

The plates of each manifold segment are preferably formed separately, and then located in abutting, side edge-to-side edge relation with the respective plates from an adjacent manifold segment; although it is possible that the respective plates of each manifold segment could be formed unitary with their corresponding plates in an adjacent manifold segment, and then bent as appropriate and layered together to form the manifold.

The manifold segments preferably have a length and width such that they fit closely in openings 30 in the dome 27 of the combustor (See, e.g., FIGS. 1 and 2). The end walls 32, 33 of the openings enclose the ends of the manifold to prevent air leakage through the dome.

The manifold segments are preferably separately fluidly connected to the stem, and receive fuel in separate circuits, such that one or more of the manifold segments can provide fuel from one circuit, while one or more manifold segments can provide fuel from another circuit. Preferably the manifold segments are arranged such the middle or central manifold segment 84 is fluidly connected via extension 69 to the pilot fuel circuit 52, and receives one-third the total flow; while the manifold segments 82 and 86 adjacent both sides of the pilot manifold segment 84 are angled outwardly at 45 degrees to the pilot manifold segment, and are fluidly connected via extensions 70 to the secondary fuel circuit 54 to each receive one-third the total flow. Thus, two-thirds the total flow (in this example) is provided to the secondary manifold segments; while one-third the total flow is provided to the pilot manifold segment. Of course, other percentages may be appropriate for other applications.

Since the air swirler assemblies for the nozzles of the pilot manifold segment are supported at an angle to the air swirler assemblies for the nozzles of the secondary manifold segments, their interaction is reduced. This allows a greater amount of air flow to be directed through the swirler assemblies of the secondary manifold segments to increase the fine atomization and quick and uniform mixing of the fuel, without the air flow through the secondary nozzles interfering with the flame from the adjacent pilot nozzles, for example during idle or low power conditions. In general, this allows maximizing the number of nozzles in the combustor, and increasing the air flow through the air swirler assembly, while minimizing their interaction.

The present invention thereby provides a novel and unique fuel injector for directing fuel from a manifold and dispensing the fuel within the combustion chamber of a combustion engine. The fuel injector allows increased air flow to achieve fine atomization and quick and uniform mixing of the fuel and air for combustion at low flame temperatures, thereby reducing NOx emissions from the engine. The fuel injector of the present invention also fits within a small envelope and is economical to manufacture and assemble. The fuel injector is particularly useful for gas turbine combustion engines on aircraft, but can also be useful in other combustion applications, such as in ground vehicles and stationary applications, or for dispensing liquids other than fuel.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. An injector for distributing liquid sprays, comprising:

an inlet fitting including a port to receive liquid, a stem assembly supported by the fitting, the stem assembly including an internal circuit fluidly connected to the port, and a manifold supported by the stem assembly and including an internal passage connected to the internal circuit in the stem assembly, the manifold including an elongated manifold segment formed of multiple plates and having a plurality of nozzles spaced along the manifold segment, wherein each of the nozzles is fluidly connected to the internal passage for delivering sprays of liquid, wherein each nozzle includes a swirl chamber formed in at least one of the plates having a shape such that liquid to be sprayed can move therein in a vortex motion toward the center of the swirl chamber, at least one non-radial feed slot intersecting the swirl chamber for directing liquid to the swirl chamber, a spray orifice at the center of the swirl chamber such that liquid to be sprayed can move from the swirl chamber to the spray orifice and then exit the spray orifice in a thin film which soon atomizes into a fine droplet mist.

2. The injector as in claim 1, wherein the nozzles are spaced apart in a linear array along the length of the manifold segment.

3. The injector as in claim 2, wherein the nozzles are spaced apart evenly.

4. The injector as in claim 3, wherein the nozzles are located along a median line of the manifold segment.

5. The injector as in claim 1, wherein the manifold segment has a planar surface and the nozzles are spaced along the surface for spraying liquid outwardly from the surface.

6. The injector as in claim 1, wherein each nozzle further includes an air swirler assembly having a cylindrical air swirler passage located in co-axial relation to the spray orifice of the nozzle such that liquid directed through each spray orifice passes through an air swirler passage and swirling air can be imparted to the liquid to cause the liquid to have a swirling component of motion; at least one air feed slot in fluid communication with each air swirler passage and extending in non-radial relation thereto for supplying air to be swirled in the air swirler passage; and an air supply passage which feeds the at least one air feed slot.

7. The injector as in claim 6, wherein a pair of air supply passages are provided along each manifold segment, on either side of the linear array of nozzles, each of which feeds the air feed slots for the air swirler passage.

8. The injector as in claim 1, wherein an extension interconnects the manifold and the stem assembly, the extension including an internal passage fluidly connecting the internal circuit in the stem assembly with the internal passage in the manifold.

9. An injector for distributing liquid sprays, comprising:

an inlet fitting including a port to receive liquid, a stem assembly supported by the fitting, the stem assembly including an internal circuit fluidly connected to the port, and a manifold supported by the stem assembly and including an internal passage connected to the internal circuit in the stem assembly, the manifold including an elongated manifold segment formed of multiple plates and having a plurality of nozzles spaced along the manifold segment, wherein each of the nozzles is fluidly connected to the internal passage for delivering sprays of liquid, wherein the manifold segment includes i) a fuel distribution assembly formed of multiple plates and including a swirl chamber with a spray orifice in the center of the swirl chamber for directing a spray of liquid from the swirl chamber, the fuel distribution assembly supported by a distribution plate connected to the extension, wherein the internal passage in the manifold is located in the distribution plate, and ii) an air swirler assembly formed of multiple plates stacked in surface-to-surface relation with one another, and providing an air swirler passage to introduce swirling air to the liquid such that the liquid spray has a swirling component of motion.

10. A fuel injector for a gas turbine engine, comprising:

an inlet fitting including a port to receive fuel, a stem supported by the inlet fitting, the stem including an internal fuel circuit fluidly connected to the fuel port, and a manifold supported by the stem, said manifold including an internal fuel passage fluidly connected to the internal fuel circuit in the stem, the manifold including an elongated manifold segment having a plurality of nozzles spaced along the manifold segment, wherein each of the nozzles includes i) a spray orifice fluidly connected to the internal fuel passage for delivering a spray of fuel; and ii) an air swirler assembly having a cylindrical air swirler passage located in co-axial relation to the spray orifice such that fuel directed through the spray orifice passes through the air swirler passage and swirling air can be imparted to the fuel to cause the fuel to have a swirling component of motion, at least one air feed slot in fluid communication with the air swirler passage and extending in non-radial relation thereto for supplying air to be swirled in the air swirler passage, and an air supply passage which feeds the at least one air feed slot in the air swirler passage.

11. The fuel injector as in claim 10, wherein the manifold segments are each formed of multiple plates.

12. The fuel injector as in claim 10, wherein the nozzles are spaced apart in a linear array along the length of the manifold segment.

13. The fuel injector as in claim 12, wherein wherein the nozzles are spaced apart evenly.

14. The injector as in claim 12, wherein the nozzles are located along a median line of the manifold segment.

15. The fuel injector as in claim 14, wherein a pair of air supply passages are provided along each manifold segment, on either side of the linear array of nozzles, and each of which feeds the air feed slots for the air swirler passage.

16. The fuel injector as in claim 10, wherein the manifold segment has a planar surface and the nozzles are spaced along the planar surface for spraying fuel outwardly from the surface.

17. The fuel injector as in claim 10, wherein each nozzle includes a bowl-shaped swirl chamber, and the spray nozzle is located at the center of the swirl chamber, such that fuel to be sprayed can move therein in a vortex motion toward the center of the swirl chamber and exit the spray orifice in a thin film which soon atomizes into a fine droplet mist, said at least one non-radial feed slot intersecting the swirl chamber for directing fuel to the swirl chamber.

18. A fuel injector for a gas turbine engine, comprising:

an inlet fitting including first and second ports, each of which receive fuel, a stem supported by the fitting, the stem including first and second internal fuel circuits fluidly connected to a respective port, and a manifold supported by the stem, said manifold including a plurality of elongated, planar manifold segments, each of which includes an internal fuel passage fluidly connected to a respective internal fuel circuit in the feed stem, and each of which includes a plurality of nozzles spaced along the manifold segment, wherein each of the nozzles is fluidly connected to the internal passage in the respective manifold segment for delivering sprays of fuel, wherein each nozzle includes i) a spray orifice fluidly connected to the internal fuel passage for delivering a spray of fuel; and ii) an air swirler assembly having a cylindrical air swirler passage located in co-axial relation to the spray orifice such that fuel directed through the spray orifice passes through the air swirler passage and swirling air can be imparted to the fuel to cause the fuel to have a swirling component of motion, at least one air feed slot in fluid communication with the air swirler passage and extending in non-radial relation thereto for supplying air to be swirled in the air swirler passage, and an air supply passage which feeds the at least one air feed slot in the air swirler passage.

19. The fuel injector as in claim 18, wherein the nozzles are evenly spaced apart in a linear array along the length of each manifold segment.

20. The fuel injector as in claim 18, further including a plurality of extensions interposed between the stem and respective manifold segments, and fluidly interconnecting a respective internal fuel circuit in the stem and an internal passage in the manifold segment.

21. The fuel injector as in claim 20, wherein the extensions are located at distinct axial locations along the stem.

22. The fuel injector as in claim 18, wherein the manifold segments are each formed of multiple plates.

23. A fuel injector for a gas turbine engine, comprising:

an inlet fitting including first and second ports, each of which receive fuel, a stem supported by the fitting, the stem including first and second internal fuel circuits fluidly connected to a respective port, and a manifold supported by the stem, said manifold including a plurality of elongated, planar manifold segments, each of which includes an internal fuel passage fluidly connected to a respective internal fuel circuit in the feed stem, and each of which includes a plurality of nozzles spaced along the manifold segment, wherein each of the nozzles is fluidly connected to the internal passage in the respective manifold segment for dispensing fuel, wherein a pair of manifold segments are located in adjacent relation to one another, and are supported at an angle to one another, such that that the fuel dispensed from a linear array of nozzles in one manifold segment is provided in a first direction, and the fuel dispensed from a linear array of nozzles in the other manifold segment is provided in another direction, at an angle to the first direction.

24. The fuel injector as in claim 23, wherein the pair of manifold segments are supported at a forty five degree angle with respect to each other.

25. The fuel injector as in claim 23, wherein the nozzles each include a spray assembly for delivering a spray of fuel.

26. A fuel injector for a gas turbine engine, comprising:

an inlet fitting including port means for receiving fuel, a stem assembly supported by the fitting, the stem assembly including internal fuel circuit means fluidly connected to the port means, and a manifold supported by the stem assembly, the manifold including a plurality of manifold segments, each of which includes an internal passage fluidly connected to the internal fuel circuit means in the stem assembly, each manifold segment including at least one nozzle, wherein a nozzle is fluidly connected to the respective internal passage for dispensing fuel, and wherein each of the manifold segments is supported at an angle to an adjacent manifold segment, such that that the fuel dispensed from one manifold segment is provided in one direction, and the fuel dispensed from an adjacent manifold segment is provided in another direction, at an angle to the one direction.

27. The fuel injector as in claim 26, wherein the nozzle further includes an air swirler assembly including a cylindrical air swirler passage located in surrounding relation to the fuel spray such that the spray of fuel passes through the air swirler passage and swirling air can be imparted to the fuel to cause the fuel to have a swirling component of motion; at least one air feed slot in fluid communication with each air swirler passage and extending in non-radial relation thereto for supplying air to be swirled in the air swirler passage; and an air supply passage which feeds the at least one air feed slot.

28. The fuel injector as in claim 26, wherein the manifold segments are planar.

29. The fuel injector as in claim 26, wherein each manifold segment is elongated, and a plurality of nozzles are located in an array along each manifold segment.

30. The fuel injector as in claim 29, wherein each manifold segment is formed of multiple plates.

31. The fuel injector as in claim 26, wherein the at least one nozzle includes a spray assembly for delivering a spray of fuel.

32. A fuel injector for a gas turbine engine, the engine including a bulkhead having adjacent wall segments located at angles to one another, with each wall segment including an injector opening, the fuel injector comprising:

an injector mount adapted to be fixed to the bulkhead;

an inlet fitting including an outer stem extending outwardly from said injector mount and port means for receiving fuel;

an inner stem extending inwardly from the injector mount and dimensioned to be received through the injector opening, the inner and outer stem including internal fuel circuit means fluidly connected to the port means; and a manifold supported by the inner stem, the manifold including a plurality of planar manifold segments, each of which includes an internal passage fluidly connected the internal fuel circuit means in the inner and outer stems, each manifold segment including a plurality of nozzles, wherein the nozzles are fluidly connected to a respective internal passage for dispensing fuel, and wherein each of the manifold segments is supported at an angle to an adjacent manifold segment, such that that the fuel dispensed from one manifold segment is provided in one direction, and the fuel dispensed from another manifold segment is provided in another direction, at an angle to the one direction.

33. The fuel injector as in claim 32, wherein each nozzle includes an air swirler assembly including a cylindrical air swirler passage located in co-axial relation to each fuel spray from the nozzle such that the fuel spray from each nozzle passes through an air swirler passage and swirling air can be imparted to the fuel to cause the fuel to have a swirling component of motion; at least one air feed slot in fluid communication with each air swirler passage and extending in non-radial relation thereto for supplying air to be swirled in the air swirler passage; and an air supply passage which feeds the at least one air feed slot.

34. The fuel injector as in claim 32, wherein the nozzles are arranged in a linear array along each manifold segment.

35. The fuel injector as in claim 32, wherein each manifold segment is formed of multiple plates.

36. The fuel injector as in claim 32, wherein the manifold segments are elongated.

37. The fuel injector as in claim 32, wherein the nozzles each include a spray assembly for delivering a spray of fuel.

38. A fuel injector for a gas turbine engine, comprising:

an inlet fitting including first and second ports, each of which receives fuel, a stem supported by the fitting, the stem including first and second internal fuel conduits fluidly connected to a respective port, and a manifold supported by the stem, the manifold including a set of three elongated, planar, adjacent manifold segments, each of which includes an internal passage fluidly connected to a respective internal fuel circuit in the stem, with a first of the manifold segments fluidly connected to one of the internal fuel circuits, and the other two of the manifold segments fluidly connected to the other of the internal fuel circuits, each of the manifold segments supporting a plurality of nozzles in a linear array along the manifold segment, wherein each of the manifold segments includes multiple layers, and each nozzle is comprised of at least one of the layers and is fluidly connected to a respective internal passage for delivering a spray of fuel, and wherein the first of the manifold segments is located intermediate the other two of the manifold segments, with the other two of the manifold segments supported at angles to the first manifold segment, such that the sprays of fuel from the nozzles of the first manifold segment are provided in one direction, and the sprays of fuel from the nozzles in the other manifold segments are provided in other directions, away from the first sprays, and wherein each nozzle further includes a multilayered air swirler assembly including a cylindrical air swirler passage located in co-axial relation to the sprays of fuel and at least one air feed slot in fluid communication with the air swirler passage and extending in non-radial relation thereto for supplying air to be swirled in the air swirler passage, such that fuel sprays each pass through an air swirler passage and swirling air can be imparted to the fuel to cause the fuel to have a swirling component of motion.

39. A liquid injector, comprising:

an inlet fitting including port means for receiving liquid, a stem assembly supported by the fitting, the stem assembly including internal liquid circuit means fluidly connected to the port means, and a manifold supported by the stem assembly, the manifold including a plurality of manifold segments, each of which includes an internal passage fluidly connected to the internal liquid circuit means in the stem assembly, each manifold segment including at least one nozzle, wherein a nozzle is fluidly connected to the respective internal passage for dispensing liquid, and wherein each of the manifold segments is supported at an angle to an adjacent manifold segment, such that that the liquid dispensed from one manifold segment is provided in one direction, and the liquid dispensed from an adjacent manifold segment is provided in another direction, at an angle to the one direction.

40. The liquid injector as in claim 39, wherein the at least one nozzle includes a spray assembly for delivering a spray of liquid.

* * * * *